US007365256B2

(12) United States Patent
Takegawa

(10) Patent No.: US 7,365,256 B2
(45) **Date of Patent: *Apr. 29, 2008**

(54) SNARE TENSIONER FOR A SNARE DRUM

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 126 days.

This patent is subject to a terminal disclaimer.

(21) Appl. No.: 11/090,890

(22) Filed: Mar. 25, 2005

(65) Prior Publication Data

US 2006/0213354 A1 Sep. 28, 2006

(51) Int. Cl.
*G10D 13/02* (2006.01)

(52) U.S. Cl. ..... 84/415

(58) Field of Classification Search ..... 84/415, 84/417, 411 R, 421
See application file for complete search history.

(56) References Cited

U.S. PATENT DOCUMENTS 5,557,053 A * 9/1996 Nickel ..... 84/415
6,020,547 A * 2/2000 Chen ..... 84/415
6,846,978 B2 1/2005 Dorfman et al.

* cited by examiner

*Primary Examiner*—Kimberly Lockett
(74) *Attorney, Agent, or Firm*—Berenato, White & Stavish

(57) ABSTRACT

A tensioner system for a snare assembly adapted to be attached to a percussion instrument, comprising a main body adapted to be fixedly mounted to the percussion instrument; a snare fastener assembly for fastening snares with respect to the main body; a rotatable tension adjuster lever rotatably mounted with respect to the main body and the snare fastener. Rotating the tension adjuster changes a position of the snare fastener to change tension of said snares. A positive locking mechanism positively locks the rotatable tension adjuster in at least one of a plurality of snare tensioning positions, wherein the positive lock mechanism mechanically connects the tension adjuster with respect to the main body fixedly mounted to the percussion instrument. The positive locking mechanism comprises a movable knob that is movable relative to said main body to change the positive locking mechanism from a locking condition to an unlocking condition.

19 Claims, 2 Drawing Sheets

Fig. 1
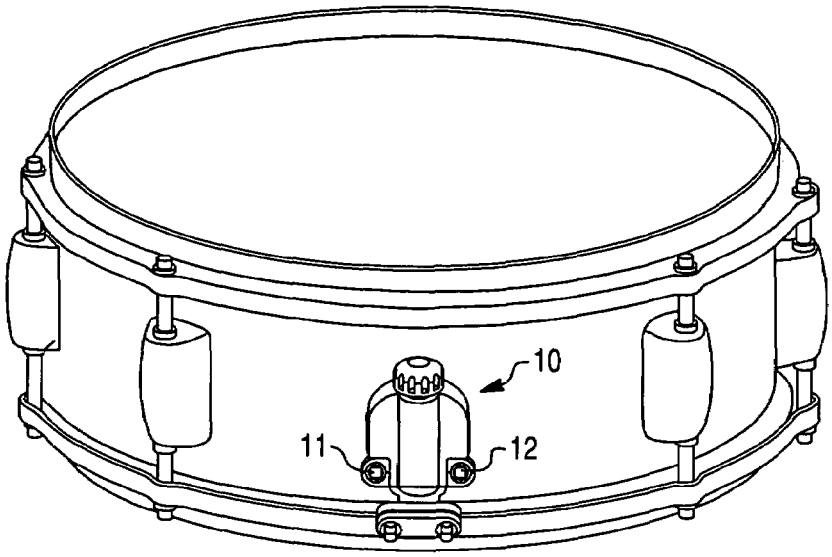
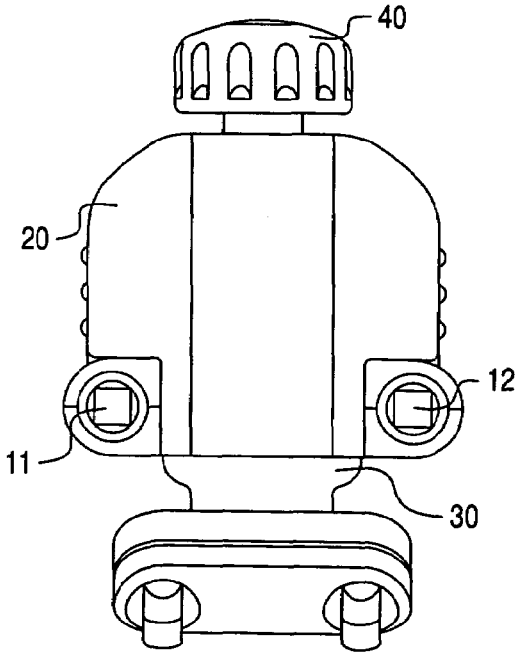
Fig. 2
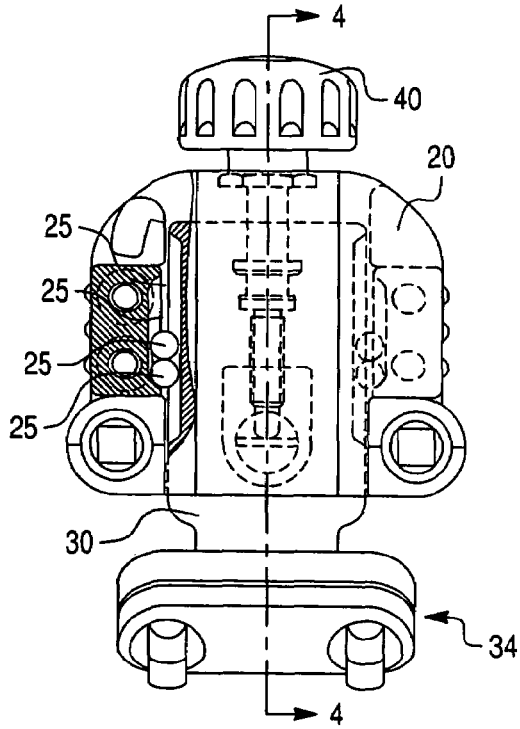
Fig. 3

Fig. 4
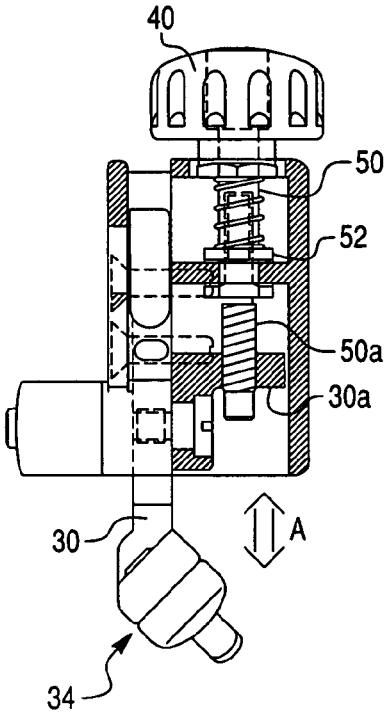
Fig. 5
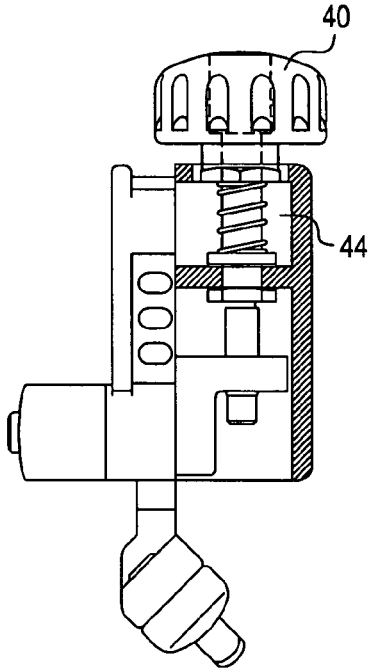
Fig. 6
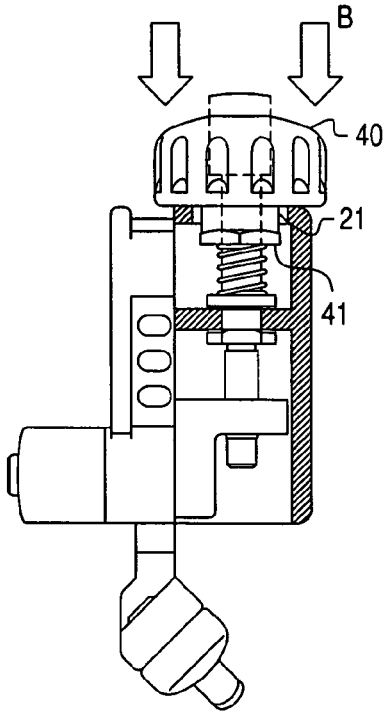
Fig. 7
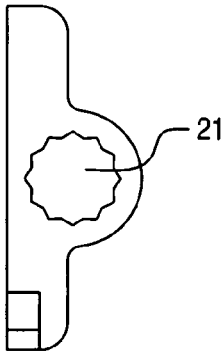
Fig. 8
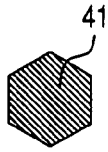
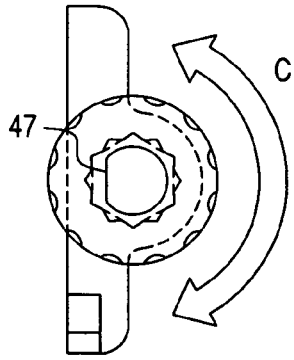
Fig. 9

SNARE TENSIONER FOR A SNARE DRUM

BACKGROUND OF THE INVENTION

1. Field of the Invention

The present invention is directed to a snare tensioner for use with a snare drum, in particular to a variable snare tension system including a positive locking mechanism.

2. Description of the Related Art

Snare drums typically include a plurality of wires, or snares, which contact a bottom drumhead of the snare drum so that the snares are vibrated by the vibration of the bottom drumhead when the snare drum is played. A strainer is typically used to tension the snares in order to change the tone produced by the drum by changing the position of the snares so that they are either in contact or not in contact with the drumhead.

Conventional strainers for snares use a lever directly connected to a piston, wherein the lever pivots about an axis generally perpendicular to the piston, so that when the lever is pivoted from one position to another, the piston drops and the tension in the snares is released so that the snares are no longer in contact with the drumhead. Some of these pivoting lever for strainers can only be operated so that the snares are either in contact with the drumhead (snares-on mode), or not in contact with the drumhead (snares-off mode), and are not adjustable to different tensions in between. Further, the strainer tends to be tensioned or released quickly, so that the snares make an unwanted "throw-off" noise against the drumhead, which is very undesirable, particularly for orchestral musicians. Other prior art systems permit intermediate adjustment of the snare tension between the snare-on and snare-off modes using the strainer.

Snare tension may also be fine tuned or finely adjusted by a tensioner system, usually with a turnable knob which is rotated to finely tune the tension in the snare to change the tone produced by the drum. However, the tension knob system in the prior art strainers typically rely on friction to hold a particular tension adjustment but the friction resistance can be overcome during heavy play. As a result, the player must constantly adjust or retighten the snares during play.

The need exists for a system and assembly for positively locking the snare tensioner system to prevent slippage or disengagement during performance or play.

SUMMARY OF THE INVENTION

The invention provides a tensioner system for a snare assembly adapted to be attached to a percussion instrument, comprising a main body adapted to be fixedly mounted to the percussion instrument; a snare fastener assembly for fastening snares with respect to the main body; a rotatable tension adjuster lever rotatably mounted with respect to the main body and the snare fastener. Rotating the tension adjuster changes a position of said snare fastener to change tension of said snares. A positive locking mechanism positively locks the rotatable tension adjuster in at least one of a plurality of snare tensioning positions, wherein the positive lock mechanism mechanically connects the tension adjuster with respect to the main body fixedly mounted to the percussion instrument.

The positive snare tensioner system comprises a movable member in the form of a knob that is movable relative to said main body to change the positive locking mechanism from a locking condition where the rotatable tension adjuster is positively blocked against rotation relative to the body portion to an unlocking condition where the rotatable tension adjuster is free to pivot with respect to the body portion.

These and other structural and functional benefits of the present invention will be apparent to those of skill in the art when viewed in light of the following description and the accompanying drawings.

BRIEF DESCRIPTION OF THE DRAWINGS

FIG. 1 is a perspective view of the snare drum and snare tensioner of this present invention.

FIG. 2 is a front view of the tensioner according to the present invention.

FIG. 3 is a partial cross sectional view of the tensioner of FIG. 2 showing the internal piston member and tension nut system.

FIG. 4 is a partial cross sectional view of the tensioner of FIGS. 3 taken along the section line IV-IV of FIG. 3.

FIG. 5 is a partial cross sectional view taken along the section line shown in FIG. 3 and showing the tensioner in a locked position.

FIG. 6 is a partial cross sectional view taken along the section line shown in FIG. 3 and showing the tensioner in an unlocked position.

FIG. 7 is a top view of a part of the main body showing the aperture in the main body.

FIG. 8 is a cross sectional view of the skirt of the adjustment knob.

FIG. 9 is a top view of the knob and main body showing the interaction of the screw member and the knob.

DETAILED DESCRIPTION OF PREFERRED EMBODIMENT

With reference to FIG. 1, the tension adjuster 10 of this invention is shown mounted to a docking station (not shown) bolted to the drum shell. Attachment bolts 11, 12 preferably have a drum key head thus making the tension adjuster 10 easy to remove with a conventional drum key with the strings and snares still attached to the tension adjuster 10. This allows the bottom head of the drum to be changed without upsetting the setting of the snares. After the bottom head of the drum is replaced, the tension adjuster 10 can be reattached to the drum and the snares will be perfectly set and aligned as before removal.

The tension adjuster 10 is shown in an isolated drawing in FIGS. 2 and 3. The tension adjuster 10 comprises a main body 20 mountable to the drum shell through attachment bolts 11, 12; a piston member 30 mounted to the main body 20; an adjustment knob 40; and tension nut system that is threaded to the piston member 30 to deliver torque from the tension knob 40 to fine tune the position of the piston member 30. Thus, the piston 30 is retained within the main body 20 connected to the shell so that the piston member 30 may reciprocate relative to the shell. As the tension knob 40 is rotated, the piston member 30 will move up and down in the direction of arrow 'A' and, as a result, the snare clamp 34 moves to adjust the tension on the snares.

Typically, snares are operably connected to piston member 30 by the snare clamp 34 in a manner that is well known to those of skill in the art.

FIG. 3 shows the piston member 30 and main body 20 with bearing members 25 in the form of steel balls disposed between the main body 20 and the piston member 30 on opposite sides of the piston member 30. Although two such ball bearing members 25 are shown on each side of the piston member 30, it may be preferable to include a different number of these bearing members 25; it has been shown that two bearing members 25 may be a preferred design. Additionally, a low-fiction bearing plate may be used in the places of the ball bearing member 25. The low-friction bearing plates or bearing members 25 reduce side-by-play of the piston member 30 and provide a smoother sliding action as the piston member 30 translates during adjustment of the snare tension.

FIG. 4 shows the tension nut system that transforms rotary torque from the tension knob 40 to linear movement of the piston member 30. The tension nut system comprises a screw member 50 that is fixed to rotate with the tension knob 40. The screw member 50 passes through a bearing member 52 and threadingly engages a leg portion 30*a* of the piston member 30 at a lower threaded region 50*a*. The bearing member 52 is fitted onto the screw member 50 to permit rotational movement of the screw member 50 while preventing axial movement of the screw member 50. When the tension knob 40 and screw member 50 are permitted to rotate relative to the housing 20, the piston member 30 will translate in the direction of arrow 'A' (FIG. 4) at a rate defined by the threads of the threaded region 50*a*.

With reference to FIGS. 5-6, the present invention further provides a positive tensioner locking mechanism. Specifically, the tensioner knob 40 is configured as a push-button release member that is spring biased by a resilient member 44 into a locking position (FIG. 5). The positive knob locking mechanism is provided by a geometric interface between a lower skirt 41 of the knob and a conforming geometric aperture 21 provided in the main body 20. In the preferred embodiment, the lower skirt 41 is formed with a predetermined geometric configuration (e.g., a hexagon), and the conforming aperture 21 is likewise formed as a corresponding geometric configuration (e.g., a hexagon or other geometric shape) that mates with the lower skirt 41.

When the knob is biased by the spring 44 into the position shown in FIG. 5, the skirt 41 is disposed in the aperture 21 so that rotation of the skirt 41 and the knob 40 is prevented; i.e., locking position.

When the knob is depressed in the direction of arrow 'B' (see FIG. 6) against the force of spring 44, the skirt 41 moves out of alignment with the aperture 21; i.e., unlocking position. In this case, the knob 40 may be rotated relative to the main body 20.

It is noted that the knob 40 is designed to slide relative to the screw member 50 when the knob is depressed, whereby a top portion of the screw member 50 protrudes from the top of the knob 40 as shown in FIG. 6. While the knob 40 can slide relative to the screw member 50, the knob 40 cannot rotate relative to the screw member 50 because there is a chamfered interface (identified generally at 47 in FIG. 9) between the screw member 50 and the knob 40. Therefore, the knob 40 may be depressed to the position shown in FIG. 6 while the screw member 50 is fixed in the axial position by the bearing member 52. As such, the screw member 50 is fixed with respect to the main body in the axial direction. In the unlocking position of FIG. 6, the knob 40 may be rotated in the direction of arrow 'C' (FIG. 9) to adjust the tension of the snares.

When the positive lever locking mechanism is in the locking position shown in FIG. 5, the knob 40 cannot rotate in the direction of arrow 'C' shown in FIG. 9 because the lower skirt of the knob 40 is mechanically locked in the aperture 21 of the main body 20. When the knob 40 is depressed in the direction of arrow 'B' (FIG. 6), the lower skirt 41 is released from the aperture 21 and the knob 40 may be rotated to thereby adjust the position of the piston 30 through the threaded interface 50*a* between the screw member 50 and the leg portion of the piston 30. When adjustment is complete, the knob 40 is released and the spring 44 biases the knob 40 into the locking position shown in FIG. 5.

The attached drawings show the preferred assembly for providing a positive locking mechanism. It is of course envisioned that the geometric interface between the skirt 41 and the aperture 21 shown in the drawings may be replaced by other mechanical locking system that prevent the knob from being accidentally or improperly rotated or loosened during use by a performer. Likewise, it will be understood by those of skill in the art that other changes in form and detail may be made to the preferred embodiments described herein without departing from the spirit and scope of this invention. For example, the positive locking system of this invention could positively lock the tension of the snares separate and apart from the knob 40. In other words, the locking system may be disposed on at a different location on the tension nut system apart from the knob 40; for example, the locking system could positively lock the piston 30 to the main body portion by disconnecting the knob 40 from the screw member 50 in the locking position and connecting these two components when adjustment is necessary.

The invention claimed is:

1. A tensioner system for a snare assembly adapted to be attached to a percussion instrument, said tensioner system comprising:

a main body adapted to be fixedly mounted to the percussion instrument;

a snare fastener assembly for fastening snares with respect to said main body;

a rotatable tension adjuster rotatably mounted with respect to said main body and said snare fastener assembly, whereby rotating said tension adjuster changes a position of said snare fastener assembly to selectively change tension of said snares; and a positive locking mechanism to positively lock said rotatable tension adjuster in at least one of a plurality of snare tensioning positions, wherein said positive lock mechanism mechanically connects the tension adjuster with respect to said main body fixedly mounted to the percussion instrument.

2. The tensioner system recited in claim 1, wherein said positive locking mechanism comprises a movable member that is movable relative to said main body to change said positive locking mechanism from a locking position where said rotatable tension adjuster is blocked against rotation relative to said main body to an unlocking position where said rotatable tension adjuster is free to rotate with respect to said main body.

3. The tensioner system recited in claim 1, wherein said rotatable tension adjuster comprises a manual knob rotatably disposed on said main body.

4. A tensioner system for a snare assembly adapted to be attached to a percussion instrument, said tensioner system comprising:

a main body adapted to be fixedly mounted to the percussion instrument;

a snare fastener assembly for fastening snares with respect to said main body;

a rotatable tension adjuster rotatably mounted with respect to said main body and said snare fastener assembly, whereby rotating said tension adjuster changes a position of said snare fastener assembly to selectively change tension of said snares; and a positive locking mechanism to positively lock said rotatable tension adjuster in at least one of a plurality of snare tensioning positions, wherein said positive lock mechanism mechanically connects the tension adjuster with respect to said main body fixedly mounted to the percussion instrument;

said rotatable tension adjuster comprising a manual knob rotatably disposed on said main body;

said knob comprising skirt portion defining an element of said positive locking mechanism, said skirt being movable relative to said main body to change said positive locking mechanism from a locking position where said rotatable tension adjuster is blocked against rotation relative to said main body to an unlocking position where said rotatable tension adjuster is free to rotate with respect to said main body.

5. The tensioner system recited in claim 4, wherein said skirt portion is blocked against movement by a corresponding surface disposed on said main body.

6. The tensioner system recited in claim 5, wherein said skirt portion is adapted to slide out of engagement with said main body to change said positive locking mechanism to said unlocking position.

7. A tensioner system for a snare assembly adapted to be attached to a percussion instrument, said tensioner system comprising:

a main body adapted to be fixedly mounted to the percussion instrument;

a snare fastener assembly for fastening snares with respect to said main body;

a rotatable tension adjuster rotatably mounted with respect to said main body and said snare fastener assembly, whereby rotating said tension adjuster changes a position of said snare fastener assembly to selectively change tension of said snares; and a positive locking mechanism to positively lock said rotatable tension adjuster in at least one of a plurality of snare tensioning positions, wherein said positive lock mechanism mechanically connects the tension adjuster with respect to said main body fixedly mounted to the percussion instrument;

said positive locking mechanism comprising a movable member that is movable relative to said main body to change said positive locking mechanism from a locking position where said rotatable tension adjuster is blocked against rotation relative to said main body to an unlocking position where said rotatable tension adjuster is free to rotate with respect to said main body;

said movable member being biased into said locking position by a resilient member.

8. The tensioner system recited in claim 5, wherein said resilient member is disposed on said main body.

9. The tensioner system recited in claim 1, wherein said positive locking mechanism comprises an abutment surface on said rotatable tension adjuster that abuts a matching surface on said main body.

10. A tensioner system for a snare assembly adapted to be attached to a percussion instrument, said tensioner system comprising:

a main body adapted to be fixedly mounted to the percussion instrument;

a snare fastener assembly for fastening snares with respect to said main body;

a rotatable tension adjuster rotatably mounted with respect to said main body and said snare fastener assembly, whereby rotating said tension adjuster changes a position of said snare fastener assembly to selectively change tension of said snares; and a positive locking mechanism to positively lock said rotatable tension adjuster in at least one of a plurality of snare tensioning positions, wherein said positive lock mechanism mechanically connects the tension adjuster with respect to said main body fixedly mounted to the percussion instrument;

said positive locking mechanism comprising an abutment surface on said rotatable tension adjuster abutting a matching surface on said main body;

said abutment surface defining a geometrical shape and said matching surface being an aperture defining a matching geometric shape, said abutment surface being selectively movable out of engagement with said matching surface to permit a change in said tension in said snares.

11. A tensioner system for a snare assembly adapted to be attached to a percussion instrument, said tensioner system comprising:

a main body adapted to be fixedly mounted to the percussion instrument;

a snare fastener assembly for fastening snares with respect to said main body;

a rotatable tension adjuster rotatably mounted with respect to said main body and said snare fastener assembly, whereby rotating said tension adjuster changes a position of said snare fastener assembly to selectively change tension of said snares; and a positive locking mechanism to positively lock said rotatable tension adjuster in at least one of a plurality of snare tensioning positions, wherein said positive lock mechanism mechanically connects the tension adjuster with respect to said main body fixedly mounted to the percussion instrument;

said rotatable tension adjuster comprising a manual knob rotatably disposed on said main body and a rotatable screw member upon which said knob is slidably disposed.

12. The tensioner system recited in claim 11, wherein said screw member transforms rotary torque from said knob into sliding movement of said snare fastener assembly.

13. The tensioner system recited in claim 11, wherein said screw member threadingly engages said snare fastener assembly.

14. A positive locking system for a snare tensioning system, said locking mechanism comprising:

a tensioning member for adjusting tension to snares of a percussion instrument, whereby linear movement of said tensioning member changes said tension in said snares;

a rotary adjustment assembly for imparting torque to cause linear movement of said tensioning member;

a locking mechanism to positively lock said tensioning member in at least one of a plurality of snare tensioning positions, wherein said positive lock mechanism is adapted to mechanically connect the rotary adjustment assembly to a main body fixedly mounted to the percussion instrument.

15. The positive locking system recited in claim 14, wherein said locking mechanism comprises a selectively releasable rotary member that passes through an aperture in said main body, said rotary member being movable to change said locking mechanism from a locking position where said tensioning member is blocked against rotation relative to said main body to an unlocking position where said tensioning member is free to rotate with respect to said main body.

16. The positive lock system recited in claim 15, wherein said rotary member has an outer perimeter portion that defines a geometric shape, and wherein said aperture defines a matching geometric shape at an inner periphery defining said aperture, whereby said rotary member mates with said aperture in said locking position.

17. A positive lock system for a snare tensioning system, said locking mechanism comprising:

a tensioning member for adjusting tension to snares of a percussion instrument, whereby linear movement of said tensioning member changes said tension in said snares;

a rotary adjustment assembly for imparting torque to cause linear movement of said tensioning member; and a locking mechanism to positively lock said tensioning member in at least one of a plurality of snare tensioning positions, wherein said positive lock mechanism is adapted to mechanically connect the rotary adjustment assembly to a main body fixedly mounted to the percussion instrument;

said locking mechanism comprising a selectively releasable rotary member that passes through an aperture in said main body, said rotary member being movable to change said locking mechanism from a locking position where said tensioning member is blocked against rotation relative to said main body to an unlocking position where said tensioning member is free to rotate with respect to said main body;

said rotary member having an outer perimeter portion that defines a geometric shape, and said aperture defining a matching geometric shape at an inner periphery defining said aperture, whereby said rotary member mates with said aperture in said locking position;

wherein said rotary member being released out of said locking position and into said unlocking position by movement of said outer perimeter portion out of said aperture.

18. The positive lock system recited in claim 1, wherein said positive knob locking mechanism includes a mating geometric interface between said rotatable tension adjuster and said main body.

19. The positive lock system recited in claim 14, wherein said positive knob locking mechanism includes a mating geometric interface between said rotatable tension adjuster and said main body.

* * * * *